United States Patent [19]

Thornburgh

[11] 4,185,607

[45] Jan. 29, 1980

[54] DUAL DISPLACEMENT ENGINE CONTROL

[75] Inventor: William F. Thornburgh, Rochester, Mich.

[73] Assignee: General Motors Corporation, Detroit, Mich.

[21] Appl. No.: 912,944

[22] Filed: Jun. 5, 1978

[51] Int. Cl.[2] ..... F02D 13/06; F02M 25/06

[52] U.S. Cl. ..... 123/198 F; 123/119 A

[58] Field of Search ..... 123/119 A, 198 F

[56] References Cited

U.S. PATENT DOCUMENTS

| | | | |
|---|---|---|---|
| 3,270,724 | 9/1966 | Dolza | 123/198 F |
| 3,800,765 | 4/1974 | Thompson | 123/119 A |
| 3,880,129 | 4/1975 | Hollis, Jr. | 123/119 A |
| 3,881,456 | 5/1975 | Nohira et al. | 123/119 A |
| 3,896,777 | 7/1975 | Masaki et al. | 123/119 A |
| 4,027,638 | 6/1977 | Moriya et al. | 123/119 A |
| 4,073,202 | 2/1978 | Aoyama et al. | 123/119 A |
| 4,090,482 | 5/1978 | Yoshida | 123/119 A |
| 4,116,178 | 9/1978 | Saito | 123/119 A |

FOREIGN PATENT DOCUMENTS 2628091 1/1977 Fed. Rep. of Germany ..... 123/198 F

OTHER PUBLICATIONS

Automotive Engineering, vol. 85, No. 5, May 1977, "A New Approach to Variable Displacement", pp. 30–34.

*Primary Examiner*—Ira S. Lazarus
*Attorney, Agent, or Firm*—C. K. Veenstra

[57] ABSTRACT

In a dual displacement internal combustion engine which operates on four cylinders at selected times and eight cylinders at other times, the air induction passage creates a subatmospheric pressure signal which is higher during the four cylinder mode than during the eight cylinder mode. An exhaust gas recirculation control valve is operated from that pressure signal, and a solenoid valve opens a port from the atmosphere to increase the pressure signal when operating on eight cylinders to provide similar operating pressure under both modes of operation.

6 Claims, 3 Drawing Figures

DUAL DISPLACEMENT ENGINE CONTROL

This invention relates to control of a dual displacement engine and provides a novel assembly and method for controlling a dual displacement engine control element such as an exhaust gas recirculation control valve.

Recirculation of exhaust gases has been developed as a method for inhibiting formation of oxides of nitrogen during the combustion process in an internal combustion engine. In general, it is desired to recirculate exhaust gases at a rate proportional to the rate of engine induction air flow. To accomplish that purpose, exhaust gas recirculation (EGR) control units have included an EGR control valve pintle positioned to maintain the pressure in the EGR passage upstream of the pintle equal to a reference pressure. Recirculation of exhaust gases has thus been varied with exhaust backpressure, which in turn varies as a function of induction air flow, to provide exhaust gas recirculation substantially proportional to induction air flow.

Such prior EGR control units generally included a transducer having a fitting sensing subatmospheric induction passage pressure, an air bleed sensing atmospheric pressure, and a bleed valve controlling air flow through the bleed to create an operating pressure which positioned the control valve pintle.

In a dual displacement engine which operates using only four cylinders at selected times and eight cylinders at other times, the subatmospheric induction passage pressure is substantially higher (the manifold vacuum is substantially lower) when using only four cylinders than when using eight cylinders under otherwise similar engine operating conditions. Accordingly, the transducer is unable to create an operating pressure low enough to provide exhaust gas recirculation during the four cylinder mode of operation at the same rate as that provided during the eight cylinder mode of operation.

This invention overcomes that difficulty by calibrating the EGR control unit to provide the necessary exhaust gas recirculation at operating pressures which can be achieved during the four cylinder mode of operation and provides means for modifying the induction passage pressure signal generated during the eight cylinder mode of operation so that it is similar to the pressure signal generated during the four cylinder mode of operation.

It will be appreciated that this invention is also applicable to dual displacement engine control elements other than an EGR control valve.

The details as well as other features and advantages of this invention are set forth in the remainder of the specification and are shown in the drawing in which.

Figure 1:
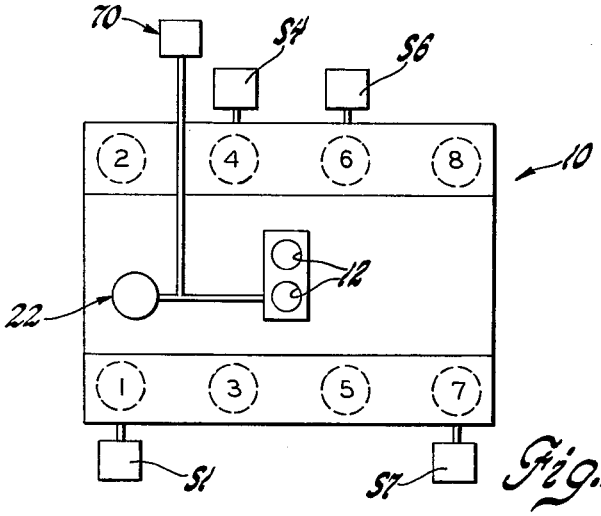
FIG. 1 is a schematic view of a dual displacement engine having an exhaust gas recirculation control system employing this invention.
Figure 2:
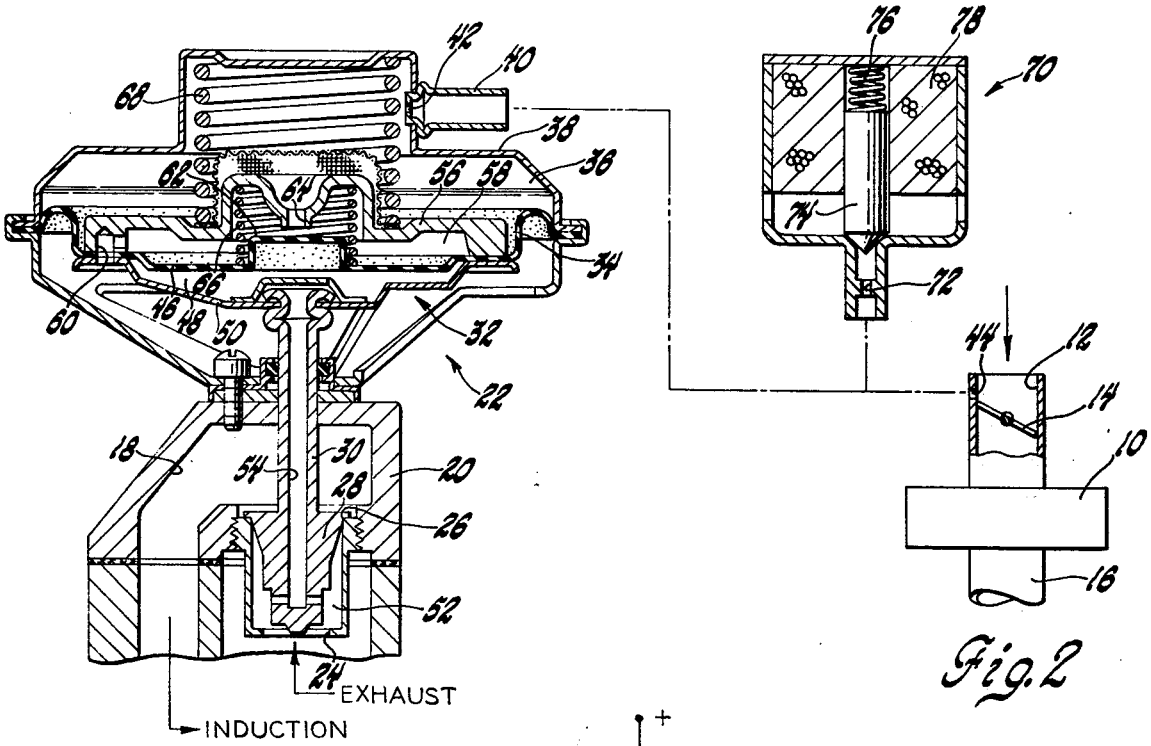
FIG. 2 is a schematic view of the EGR control system of FIG. 1 showing certain details of construction of the EGR control unit together with a solenoid operated air bleed for increasing the induction passage pressure signal during the eight cylinder mode of operation.

Referring to the drawing, an internal combustion engine 10 has a plurality of cylinders or combustion chambers 1 through 8. Combustion chambers 1, 4, 6 and 7 have solenoids S1, S4, S6 and S7 which may be energized to prevent the inlet and exhaust valves for combustion chambers 1, 4, 6 and 7 from opening, thus disabling combustion chambers 1, 4, 6 and 7 at selected times. When deenergized, solenoids S1, S4, S6 and S7 permit normal operation of combustion chambers 1, 4, 6 and 7.

It will be appreciated that while engine 10 is here exemplified as a V-8 engine in which combustion chambers 1, 4, 6 and 7 may be disabled at selected times, this invention is fully applicable to V-8 engines in which other combustion chambers may be disabled and to engines of other configurations.

Engine 10 also has air induction passages 12, throttles 14 controlling induction air flow through passages 12, and an exhaust passage 16. An exhaust gas recirculation passage 18 extends from exhaust passage 16 through the body 20 of an EGR control unit 22 and then to induction passages 12 downstream of throttles 14.

An orifice 24 is disposed in exhaust gas recirculation passage 18 upstream of a valve seat 26. A control valve pintle 28 is associated with valve seat 26 and has a stem 30 secured to a transducer 32 which is carried on an annular operating diaphragm 34.

Diaphragm 34 forms a portion of an operating pressure chamber 36 which is closed by a cover 38. Cover 38 has a fitting 40 with an aperture 42 for sensing the pressure signal created at a port 44 in one of the induction passages 12 adjacent the edge of throttle 14. Aperture 42 senses the subatmospheric induction passage pressure downstream of throttle 14 during open throttle operation and the substantially atmospheric pressure upstream of throttle 14 during idle and other closed throttle modes of operation.

Transducer 32 includes a control diaphragm 46, formed as an inward extension of annular operating diaphragm 34, which defines a portion of a control pressure chamber 48 closed by a lower plate 50. Control pressure chamber 48 senses the pressure in the zone 52 of EGR passage 18 between orifice 24 and valve seat 26 through the passage 54 formed by hollow valve stem 30. Transducer 32 also includes an upper plate 56 which cooperates with control diaphragm 46 to define a chamber 58 open to the atmosphere through an inlet 60.

Control diaphragm 46 carries a bleed valve 62 which controls air flow into operating pressure chamber 36 through a bleed 64 formed in upper plate 56.

During operation, an increase in pressure in zone 52 is sensed in control pressure chamber 48, and control diaphragm 46 lifts bleed valve 62 against the bias of a spring 66 and the atmospheric pressure in chamber 58 to obstruct air flow through bleed 64. The operating pressure in chamber 36 is then reduced by the subatmospheric pressure signal sensed through fitting 40 during open throttle operation, and operating diaphram 34 is raised against the bias of a spring 68 to lift control valve pintle 28 from valve seat 26. The resulting increase in the exhaust gas recirculation area between control valve pintle 28 and valve seat 26 provides increased exhaust gas recirculation, and the pressure in zone 52 is reduced to balance the control pressure in chamber 48 with the reference pressure created by the bias of spring 62 and atmospheric pressure in chamber 58.

Upon a decrease in the pressure in zone 52, spring 66 and the atmospheric pressure in chamber 58 lower control diaphragm 46, moving bleed valve 62 away from air bleed 64 to permit air flow through bleed 64 into chamber 36. The increased operating pressure in chamber 36 then allows spring 68 to lower operating diaphragm 34 and control valve pintle 28. The resulting decrease in exhaust gas recirculation area reduces exhaust gas recirculation and the pressure in zone 52 increases to balance the control pressure in chamber 48 with the reference pressure.

EGR control unit 22 thus positions control valve pintle 28 to produce an exhaust gas recirculation area which provides exhaust gas recirculation at rates establishing the pressure in zone 52 equal to the reference pressure. When the pressure in zone 52 equals the reference pressure, the flow of exhaust gases into zone 52 varies as a function of the exhaust backpressure in passage 16. Since the exhaust backpressure is a function of the flow through engine 10—that is, a function of the exhaust gas flow through passage 16 and thus the induction air flow through passages 12—exhaust gas recirculation through EGR passage 18 will be proportional to induction air flow through passages 12.

A regulating unit 70 has a restricted port 72 opening from the atmosphere to fitting 40. A regulating valve 74 is biased by a spring 76 to obstruct port 72 and forms a solenoid armature which is pulled back against the bias of spring 76 to open port 72 when a solenoid coil 78 is energized.

Figure 3:
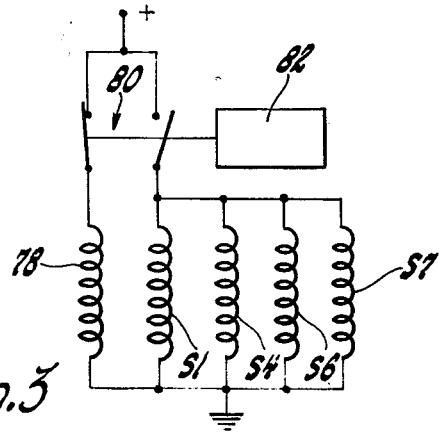
FIG. 3 is a schematic view of a control circuit for operating the FIG. 2 solenoid.

As shown in FIG. 3, a switching mechanism 80 operated by a control 82 energizes coil 78 during the eight cylinder mode of operation when solenoids S1, S4, S6 and S7 are deenergized. Air flow through port 72 to fitting 40 thus increases the subatmospheric induction passage pressure signal sensed during open throttle operation. Coil 78 is deenergized during the four cylinder mode of operation when solenoids S1, S4, S6 and S7 are energized, and valve 74 then obstructs air flow through port 72 to fitting 40.

During the four cylinder mode of operation the subatmospheric induction passage pressure signal generated during open throttle operation is higher than the pressure signal generated during the eight cylinder mode of operation under otherwise similar engine operating conditions. Thus as the engine approaches wide open throttle operation, the subatmospheric induction passage pressure signal will approach atmospheric pressure faster in the four cylinder mode of operation than in the eight cylinder mode of operation. EGR control unit 22 is calibrated to allow spring 68 to engage control valve pintle 28 with valve seat 26 as the operating pressure in chamber 36 approaches atmospheric pressure, thus allowing for maximum power operation. By lifting regulating valve member 74 from port 72 during the eight cylinder mode of operation, the pressure sensed by fitting 40 is similar to that sensed with port 72 closed during the four cylinder mode of operation. Accordingly, the operating pressure in chamber 36 approaches atmospheric pressure and allows spring 68 to engage control valve pintle 28 with valve seat 26 under similar conditions both during the four cylinder mode of operation and the eight cylinder mode of operation.

The embodiments of the invention in which an exclusive property or privilege is claimed are defined as follows:

1. An engine control assembly for a dual displacement engine having a plurality of combustion chambers and means for disabling some of said combustion chambers at selected times, said engine also having an air induction passage that creates a subatmospheric pressure signal which is higher at said selected times than at other times, said assembly comprising a diaphragm defining a portion of an operating pressure chamber having a fitting for sensing said pressure signal to create an operating pressure, means for varying said operating pressure in accordance with an engine operating condition, and an engine control element positioned by said diaphragm in accordance with said operating pressure, and wherein the improvment comprises a port opening from the atmospheric to said fitting for increasing said subatmospheric pressure signal, and means for obstructing flow through said port at said selected times, whereby said fitting senses similar pressures and said diaphragm positions said control element in a similar manner both at said selected times and at said other times.

2. An exhaust gas recirculation control assembly for a dual displacement engine having a plurality of combustion chambers and means for disabling some of said chambers at selected times, said engine also having an induction passage for induction air flow to said chambers that creates a subatmospheric pressure signal which is higher at said selected times than at other times and a recirculation passage for exhaust gas recirculation to said induction passage, said assembly comprising a diaphragm defining a portion of an operating pressure chamber having a fitting for sensing said pressure signal and also having an air bleed and combining the pressures sensed through said aperture and said air bleed to create an operating pressure, a control valve in said recirculation passage and positioned by said diaphragm to permit exhaust gas recirculation in inverse relation to said operating pressure, and a valve varying flow through said bleed to create an operating pressure for positioning said control valve to provide exhaust gas recirculation in accordance with engine operating conditions, and wherein the improvement comprises a port opening from the atmosphere to said fitting for increasing said subatmospheric pressure signal, and means for obstructing flow through said port at said selected times, whereby said fitting senses similar pressures and said diaphragm positions said control valve in a similar manner both at said selected times and at said other times.

3. An exhaust gas recirculation control assembly for a dual displacement engine having a plurality of combustion chambers and means for disabling some of said chambers at selected times, said engine also having an induction passage for induction air flow to said chambers that creates a subatmospheric pressure signal which is higher at said selected times than at other times and a recirculation passage for exhaust gas recirculation to said induction passage, said assembly comprising an operating diaphragm defining a portion of an operating pressure chamber having a fitting for sensing said pressure signal and also having an air bleed and combining the pressures sensed through said aperture and said air bleed to create an operating pressure, a control valve in said recirculation passage and positioned by said diaphragm to permit exhaust gas recirculation in inverse relation to said operating pressure, a control diaphragm defining a portion of a control pressure chamber having means for sensing the pressure in a zone of said recirculation passage, and a bleed valve positioned by said control diaphragm to obstruct flow through said bleed when the control pressure in said control pressure chamber exceeds a reference pressure, whereby said control valve is positioned to provide exhaust gas recirculation at rates which establish the pressure in said zone necessary to maintain said control pressure equal to said reference pressure and thus provide exhaust gas recirculation as a proportion of induction air flow, and wherein the improvement comprises a port opening from the atmosphere to said fitting for increasing said subatmospheric pressure signal, and means for obstructing flow through said port at said selected times, whereby said fitting senses similar pressures and said operating diaphragm positions said control valve in a similar manner both at said selected times and at said other times.

4. The method of controlling an engine control element in a dual displacement engine having a plurality of combustion chambers and means for disabling some of said chambers at selected times, said engine also having an air induction passage that creates a subatmospheric pressure signal which is higher at said selected times than at other times, said method comprising the steps of creating a subatmospheric operating pressure by sensing said pressure signal, varying said operating pressure in accordance with an engine operating condition, positioning said control element in accordance with said operating pressure, and increasing said subatmospheric pressure signal at said other times to create an operating pressure similar to the operating pressure created at said selected times whereby said control element is positioned in a similar manner both at said selected times and at said other times.

5. The method of controlling exhaust gas recirculation in a dual displacement engine having a plurality of combustion chambers and means for disabling some of said chambers at selected times, said engine also having an induction passage for induction air flow to said chambers that creates a subatmospheric pressure signal which is higher at said selected times than at other times, a recirculation passage for exhaust gas recirculation to said induction passage, and a control valve in said recirculation passage, said method comprising the steps of creating a subatmospheric operating pressure by sensing said pressure signal and by sensing atmospheric pressure through an air bleed, positioning said control valve to produce an exhaust gas recirculation area in inverse relation to said operating pressure, varying flow through said bleed to create an operating pressure for positioning said control valve to provide exhaust gas recirculation in accordance with engine operating conditions, and increasing said pressure signal at said other times to create an operating pressure similar to the operating pressure created at said selected times whereby said control valve is positioned in a similar manner both at said selected times and at said other times.

6. The method of controlling exhaust gas recirculation in a dual displacement engine having a plurality of combustion chambers and means for disabling some of said chambers at selected times, said engine also having an induction passage for induction air flow to said chambers that creates a subatmospheric pressure signal which is higher at said selected times than at other times, a recirculation passage for exhaust gas recirculation to said induction passage, and a control valve in said recirculation passage, said method comprising the steps of creating a subatmospheric operating pressure by sensing said pressure signal and by sensing atmospheric pressure through an air bleed, positioning said control valve to produce an exhaust gas recirculation area in inverse relation to said operating pressure, varying flow through said bleed to create an operating pressure for positioning said control valve to provide exhaust gas recirculation at rates which maintain the pressure in a zone of said recirculation passage equal to a reference pressure and thus provide exhaust gas recirculation as a proportion of induction air flow, and increasing said pressure signal at said other times to create an operating pressure similar to the operating pressure created at said selected times whereby said control valve is positioned in a similar manner both at said selected times and at said other times.

* * * * *